United States Patent [19]

Blytas

[11] 4,094,355

[45] June 13, 1978

[54] HEAT RECOVERY PROCESS

[75] Inventor: George C. Blytas, Houston, Tex.

[73] Assignee: Shell Oil Company, Houston, Tex.

[21] Appl. No.: 725,759

[22] Filed: Sep. 23, 1976

[51] Int. Cl.[2] ..... F25B 15/00

[52] U.S. Cl. ..... 165/1; 62/112; 62/476; 62/101

[58] Field of Search ..... 165/1; 62/101, 476, 62/148, 112

[56] References Cited

U.S. PATENT DOCUMENTS

| | | | |
|---|---|---|---|
| 2,210,899 | 8/1940 | Campbell | 261/11 |
| 2,384,861 | 9/1945 | Roswell | 62/119 |
| 2,464,072 | 3/1949 | Cornelius | 62/101 |
| 3,296,814 | 1/1967 | Lynch et al. | 62/112 |
| 3,483,710 | 12/1969 | Bearint | 62/101 |
| 3,585,810 | 6/1971 | Sander et al. | 62/148 |
| 3,608,628 | 9/1971 | Leonard, Jr. | 165/62 |
| 3,609,086 | 9/1971 | Modahl et al. | 62/112 |
| 4,020,895 | 5/1977 | Schafer | 165/1 |

*Primary Examiner*—Lloyd L. King
*Attorney, Agent, or Firm*—Albert J. Adamcik

[57] ABSTRACT

Process for recovery of heat characterized by the concentration of heat from a heat source and transfer of the heat to raise the temperature of a heat receiving medium above that of the heat source.

20 Claims, 2 Drawing Figures

HEAT RECOVERY PROCESS

BACKGROUND OF THE INVENTION

Spiraling energy costs have renewed interest recently in the recovery of energy from a variety of energy sources. In particular, the recovery of thermal energy from low temperature waste heat streams and low-to-moderate temperature natural heat sources has received such study. For example, work has been done recently on the recovery of thermal energy from brines in a geothermal power plant, and on the recovery of energy from the exhausts of gas turbines and internal combustion engines. The present invention is concerned with the utilization of thermal energy, i.e., heat, from various heat sources, particularly heat sources having a relatively low heat content. These so-called "low grade" heat sources are found, e.g., in many industrial and commercial installations, such as refineries, chemical plants, and processing plants as well as in geothermal sources, etc., and generally, whatever the medium, will have a temperature of or will transfer temperatures on the order of 100° C to 150° C or 175° C. The invention has application to higher temperature heat sources, of course, but the great advantage of the invention resides in the fact that low grade heat sources may be utilized.

SUMMARY OF THE INVENTION

Briefly, the invention comprises a process in which thermal energy derived from a heat source, preferably a low grade heat source, is concentrated and transferred to another medium. If the heat source is steam, it may be used directly, exchanged indirectly with liquid water to make steam, or exchanged or combined with low grade steam to increase the heat content of the low grade steam. If the heat source is other than steam, it may be heat exchanged with liquid water to produce steam. In any event, even if "low grade," the heat source must be steam or be suitable for converting liquid water into steam.

Accordingly, the invention, in one form, comprises a process for transferring thermal energy comprising contacting steam and a water absorbent liquid or solution in a contact zone under conditions to absorb water, form a solution or dilute the solution, and raise the temperature of the solution; and transferring heat from the diluted or higher temperature solution by indirect heat exchange to a medium to be heated, thereby raising the temperature of the medium. The medium to be heated is a matter of choice, but liquids, such as water, are normally preferred. In its preferred form, the invention comprises a multi-stage process for transferring thermal energy comprising contacting steam and a water absorbent solution in a first contact zone under conditions to absorb water, dilute the solution, and raise the temperature of the solution, the solution being in indirect heat exchange with an aqueous stream and raising the temperature of the aqueous stream, preferably converting at least the bulk of the aqueous stream to stream, passing diluted solution from the first contact zone to a second contact zone, passing the aqueous stream of raised temperature produced in the first contact zone to a second contact zone wherein the stream is contacted with the diluted solution from the first contact zone, under conditions to absorb water and dilute further the solution, and raise further the temperature of the solution, and transferring heat from the further diluted or heavily diluted solution to a medium to be heated.

Preferably, the diluted or heavily-diluted solution is regenerated by evaporating the diluted or heavily-diluted solution, and then returning the concentrated solution to the contact or first contact zone. The initial heat source is a preferred source of heat for this evaporation, and the invention additionally provides a variety of novel energy saving features. Use of the invention makes possible the recovery of thermal energy at, for example, 100° C. etc., and the concentration and "upgrading" of the energy to provide, in some embodiments, the heating of a desired medium to 250° C or higher.

This concentration is accomplished, a noted supra, by contacting steam, or steam produced by heat exchange with a heat source, with an absorbent solution for the steam. Any suitable water absorbent solution may be employed, i.e., any solution capable of absorbing water under the conditions specified herein. For example, mixtures of polar substances such as water and a non-volatile alcohol, or water and electrolytes may be employed. Particularly preferred are electrolytes, especially the lithium halides, and some polyols, such as ethylene glycol, or more preferably, glycerin. Solutions of lithium bromide and combinations of lithium bromide and calcium bromide are most preferred. Those skilled in the art may readily characterize suitable electrolytes by routine determination of their vapor pressure, solubility, and $H_2O$ absorption characteristics, allowing for such considerations as corrosion and decomposition characteristics.

The volume of absorbent employed, as well as the volume of steam used, is, of course, dependent on such factors as the size of the heat supply, etc. Those skilled in the art, given the parameters set forth herein, may adjust the quantities of steam and absorbent to operate the process of the invention with a thermal efficiency approaching 0.3, or greater, excluding minimal pumping, etc. considerations.

In general, the ratio of steam sorbed/sorbing solution determines the magnitude of net heat available at the higher temperature; the higher this ratio, the greater is the upgrading potential of the system. This is due to the fact that a large ratio indicates that the sensible heat capacity of the absorbent is relatively small. Hence the heat energy used in raising the temperature of the system itself is a small portion of the total heat effect, which is the heat of absorption of steam in the aqueous solution.

As indicated, the contact zone or zones will be operated under conditions to absorb water, dilute the solution or solutions and raise the temperature of the solution or solutions in the respective contact zone or zones. In general, these conditions include appropriate pressures, temperatures, and concentrations of the absorbent solutions, as outlined more fully hereinafter. While the conditions of operation are widely variable, those skilled in the art will recognize that, if more than one contact zone is employed, the interdependency of such contact zones requires that any variation of conditions in one contact zone must be compensated for by adjustment of conditions within the other contact zone. Additionally, those skilled in the art will recognize that the pressures, temperatures, and concentrations of absorbents in any given contact zone are also interdependent, so that, for example, a change in pressure in a given contact zone will result in concomitant changes in concentration and temperature in that zone. Accordingly, each of the sets of conditions disclosed hereinafter are to be understood in conjunction with the other conditions set forth, since, for example, a given temperature change will call for corresponding pressure and concentration changes. In general, the conditions outlined herein satisfy equilibrium conditions.

The proportions of solute to water in the absorbent solutions employed may be varied greatly. For example, were electrolyte compositions are employed, the concentration of the electrolyte in the absorbent solution may range, in the initial contact zone, from 40 percent by weight to 95 percent by weight, based on the total weight of the solvent and electrolyte, with concentrations of 60 percent by weight to 95 percent by weight being preferred. As a practical matter, as those skilled in the art will recognize, the only significant limitation on the ratio of solute to water is the pumpability of the combination. Concentrations of solutions of non-electrolyte absorbents are widely variable. If the non-electrolyte absorbent is a liquid, water in any significant amount would not normally present on startup, and the degree of water removal by regeneration is dictated by economics. Accordingly, quite low water contents in such absorbent solutions or liquids, e.g, 5 percent, or lower, are employable.

Temperature of the absorbent solution entering the contact zone or first contact zone will be determined by the temperature of the heat source available. As indicated, the invention is well adapted to heat sources at temperatures of from 100° C or 110° C to 250° C or higher. Thus, allowing for heat transfer losses, the absorbent solution will have approximately these temperatures. The aqueous stream in heat exchange with the solution, in the preferred system, will have an initial or inlet temperature of from about 100° C to about 250° C, preferably from about 110° C to 200° C. The temperature of the steam supplied to the contact zone or first contact zone will also be limited by the temperature of the heat source, e.g, 100° C to 250° C or greater. Temperatures of the solution in a second contact zone are dependent on those utilized in the first contact zone. The solution entering the second contact zone will be at the final temperature of the condensing solution of the first contact zone, minus any heat losses incurred between units, and the aqueous stream or steam supplied to the second contact zone will also have this temperature. For example, using the low grade heat source mentioned, temperatures of the solution entering the second contact zone may range from 130° C to about 280° C, with temperatures preferably between about 160° C and 220° C. As indicated, temperatures of the aqueous stream or steam supplied to the second contact zone will approximate these temperatures.

As those skilled in the art will appreciate, the sorption of steam in the contact zone or first contact zone raises the temperature of the solution to an extent determined by the ratio, steam sorbed. The temperature rise in the contact zone or mass of diluted solution first contact zone is such that the pressure of the resulting solution after steam sorption is still less than (but approaches) that of the steam pressure at heat source temperature. This condition must be obeyed in order to provide driving force for the sorption of steam in the contact zone or first contact zone. In a second contact zone, the pressure of the steam supplied to the zone must exceed the vapor pressure of the diluted solution leaving the zone. The difference in vapor pressure between the steam and the solution provides the driving force for condensation. By way of example, steam pressure in the contact zone or first contact zone may normally range from about 15 PSIA to about 300 PSIA, and preferably from 30 PSIA to 200 PSIA. In a second contact zone, pressures may normally range from about 100 PSIA to about 600 PSIA, and preferably from about 150 PSIA to about 400 PSIA. It is to be understood that these pressures refer to vapor pressures, and not the mechanical pressure used to pump the solutions or aqueous streams from unit to unit.

Pressures of steam generated by the heat source will depend on the temperature of the heat source, etc. In regenerating the diluted absorbent solution at a given waste heat temperature, the condenser operating pressure may be adjusted by those skilled in the art to achieve efficient evaporation. For example, if the heat source is used to regenerate the solution and is at, say 110° C, the condensing pressures may have to be maintained at less than 4 PSIA for efficient evaporation. With higher waste heat temperatures, higher condenser pressures may be adequate.

DETAILED DESCRIPTION OF THE INVENTION

Figure 1:
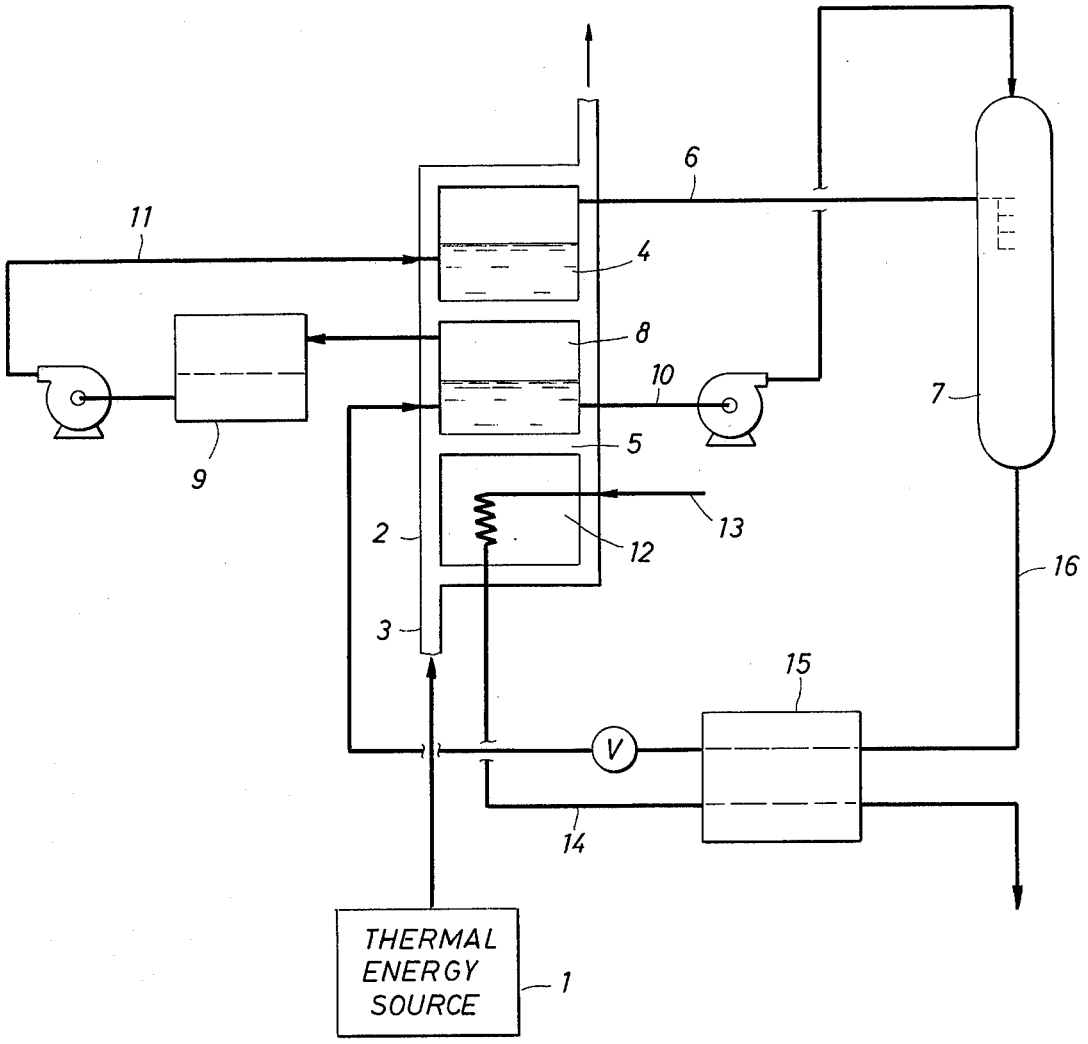
FIG. 1 of the drawing illustrates a thermal energy source.

In order to illustrate the invention, reference is made to the accompanying drawing. In FIG. 1, a thermal energy source 1, such as a hot waste stream, a geothermal source, or stack gas, enters combination boiler-generator-preheater 2 at 3. For the purpose of illustration, steam at 150° C will be employed as the thermal energy source, although those skilled in the art will readily recognize the utility of many other thermal energy sources. Again, although unit 2 is a preferred heat recovery configuration, other units may be used. For example, separate generator and evaporator units may be used. The advantage of unit 2 lies in its excellent heat recovery characteristics. A steam source may be used directly, if contaminants in the steam are not a problem. Moreover, it is within the scope of the invention that multiple different temperature sources of heat may be used, so that, e.g., low temperature steam might be supplied to unit 7 (to be discussed more fully hereinafter) to supplement the heat supply. Unit 2 comprises, as shown, a three-sectioned heat exchange apparatus. In section 4 a liquid water supply is converted to steam by indirect heat exchange with the steam passing through the passages 5 of unit 2. Steam at, e.g., 150° C and 65 PSIA is passed through line 6 to contactor 7 at a rate of 61 lbs./hr. Concomitantly, the steam in passages 5 of unit 2 provides heat for evaporation of water from a regenerating absorbent solution of glycerin in section 8. Section 8 is operated, at 150° C, and condenser 9 is operated at about 5 PSIA, so that an absorbent glycerin solution containing, e.g., about 3.5 percent water by weight is provided in line 10 at 1,000 lbs./hr. Water from condenser 9 is passed through line 11 to boiler 4. At the same time, the steam in passages 5 provides heat in section 12 for preheating a medium to be heated in line 13. The medium to be heated in line 13 is preferably water, as indicated previously.

Steam from line 6 and the glycerin solution in line 10 are combined or contacted in contactor 7. Because, as indicated previously, the vapor pressure of the diluted absorbent solution leaving unit 7 is less than the steam pressure in line 6, the steam will "condense" or be absorbed, diluting the absorbent solution and raising the temperature of the diluted solution. For the conditions mentioned, the temperature of the solution will be raised to a calculated temperature of about 188° C, and the solution is diluted to approximately 9 percent by weight. Concomitantly, water from line 13, having been heated to approximately 150° C in section 12 of unit 2 is passed through line 14 and pumped in indirect heat exchange unit 15 with the diluted solution from line 16. The solution in line 16 is pumped through exchanger 15 and returned to 8 for regeneration. Obviously, this heat exchange procedure may be carried out in unit 7 by suitable equipment modification, if desired.

Figure 2:
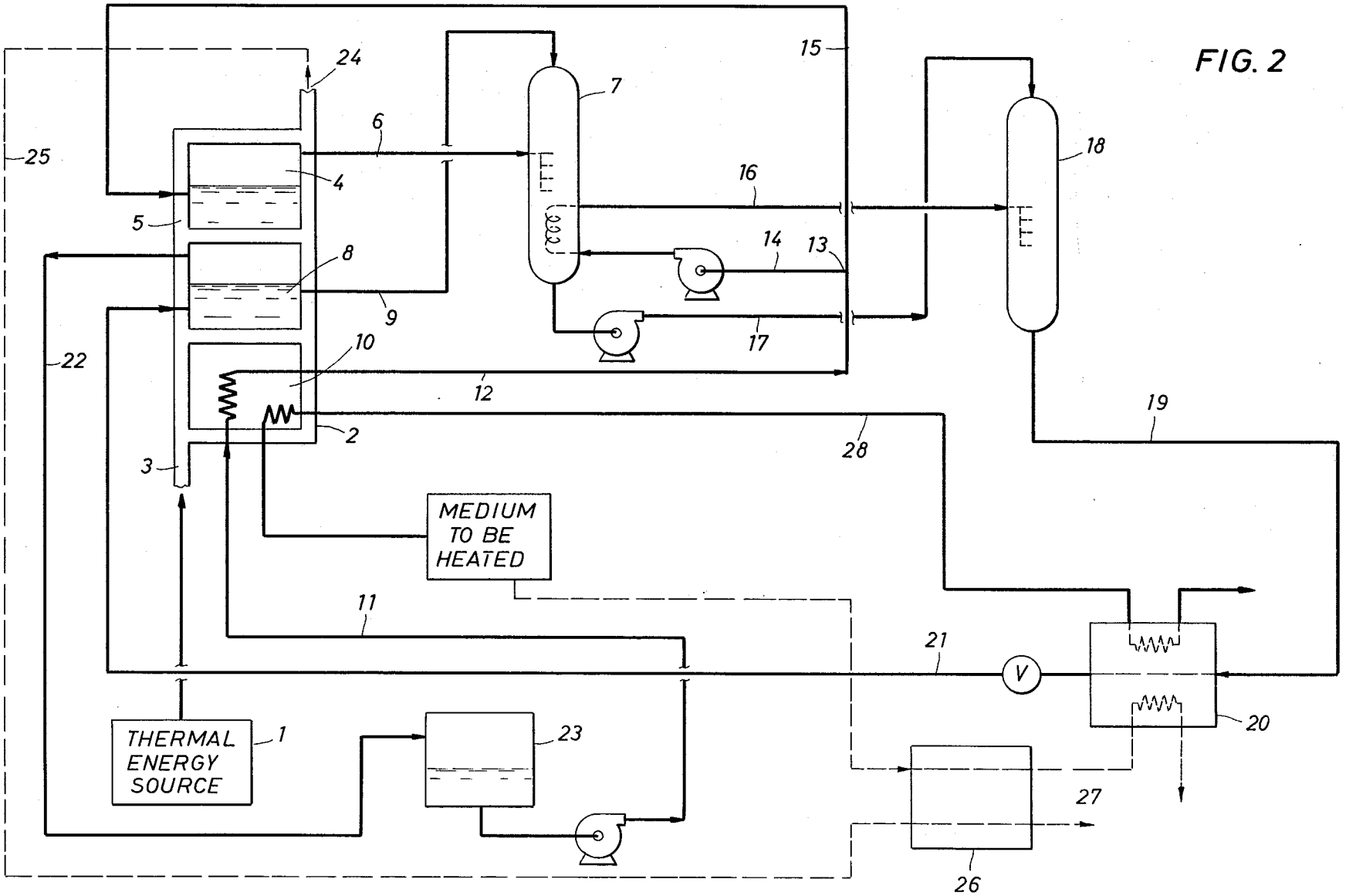
FIG. 2 of the drawing illustrates the use of two contact zones.

FIG. 2 of the drawing illustrates the use of two contact zones in the process of the invention. In FIG. 2, numbers 1 through 8 represent units analogous to those of FIG. 1, and the operation of such units will not be detailed again except insofar as necessary to describe the use of a different absorbent solution.

In section 4 of FIG. 2, a liquid water supply is converted to steam by indirect heat exchange with the steam passing through the passages 5 of unit 2. Steam at, e.g., 150° C and 60 PSIA, is passed through line 6 to contactor 7 at a rate of 125 lbs./hr. Concomitantly, the steam in passages 5 of unit 2 provides heat for evaporation of water from a regenerating absorbent solution of LiBr in section 8. Section 8 is operated at 150° C and about 5 PSIA, so that the absorbent LiBr solution containing, e.g., about 32.5 percent water by weight is provided in line 9 at 1,000 lbs./hr. At the same time, the steam is passage 5 provides heat in section 10 for water in line 11. The water in line 11 may be from any water source, but preferably comes from a source to be discussed more fully hereinafter.

Steam from line 6 and the LiBr solution in line 9 are contacted in contactor 7. Because, as indicated previously, the vapor pressure of the diluted absorbent solution leaving unit 7 is less than the steam pressure in line 6, the steam will "condense" or be absorbed, diluting the absorbent solution and raising the temperature of the diluted solution. For the conditions mentioned, the temperature of the solution will be raised to a calculated temperature of about 200° C, and the solution is diluted to approximately 40 percent by weight. Concomitantly, water from line 11, having been heated to 150° C in section 10 of unit 2 is passed through line 12 and may be divided in portions at 13 into lines 14 and 15. The water in line 14 is pumped through contactor 7 in indirect heat exchange with the LiBr solution. The temperature of the water is raised to approximately that of the LiBr solution, i.e., about 200° C, and at least the bulk of the water is converted to steam. The aqueous stream leaves contactor 7 through line 16. Water in line 15 is circulated to section 4 of unit 2.

From contactor 7, diluted LiBr solution at, e.g., about 200° C is pumped through line 17 to a second contactor 18. Concomitantly, at least the bulk of the aqueous steam in line 16 is passed into contactor 18. Preferably, even if some liquid water is present in the aqueous stream, all of the stream is sent to contactor 18. Accordingly, the aqueous stream from line 16, at a pressure of about 210 to 220 PSIG, is contacted with LiBr solution from line 17 in contactor 18, with resultant absorption of water, further dilution of the LiBr solution, and raising of the temperature of the solution to a calculated temperature of about 245° C. The concentration of the further diluted solution is about 43.5 percent by weight LiBr. The heated, dilute LiBr solution may be heat exchanged indirectly with a stream or medium to be heated (not shown) in contactor 18 or may be passed through line 19 to separate heat exchanger 20, which may be a direct or indirect heat exchanger, depending on the material to be heated. If the medium to be heated is a water stream, the heat exchange is preferably indirect, and the temperature of the water stream will be raised to approximately the temperature of the LiBr solution, i.e., about 245° C.

The now cooled, heavily diluted LiBr solution from heat exchanger 20 is passed through line 21 back through an expansion valve to section 8 of unit 2 where it is concentrated for re-use.

The design shown in the drawing permits additional heat recovery. More particularly, water vapor from section 8 at 150° C and 5 PSIA, may be passed through line 22 to condenser 23, where the water vapor is condensed. The liquid water may then be pumped through line 11 thus providing water, as indicated previously, through section 10, line 12, etc., instead of depending on a separate source of water. Simultaneously, if steam is the thermal energy source provided by 1, the steam exiting unit 2 at 24 may be passed through line 25 (dotted line) to pre-heater 26 wherein the steam is exchanged with a medium to be heated (source line of medium shown as dotted line). The steam or water exiting 26 may be exhausted to waste or used further, while the heated medium may be passed through line 27 (dotted line) to exchanger 20 or contactor 18 where it is heated, as discussed previously. Preferably, however, the medium to be heated may be heat exchanged or pre-heated initially with the heat source, for example, in a modified unit 2, so that the medium to be heated will already have the heat source temperature before it is passed through line 28 and heated, for example, in unit 20. Again, multiple different temperature sources of heat may be used, so that, e.g., low temperature steam might be supplied to unit 7, while higher temperature steam from an available source might be supplied to unit 18. Those skilled in the art will recognize that units 7 and 18 may be constructed as one large unit rather than as separate structures, thus realizing additional heat and capital economies.

The following tables illustrate calculated temperature, concentration, and pressure values from various absorbents and heat sources.

TABLE I

Heat source temperature of 150° C; absorbent is a solution of a 50:50 composition of $CaBr_2$ and LiBr in 17.0 wt. percent water.

| | ABSORBENT CONCENTRATION (WEIGHT PERCENT OF WATER) | TEMPERATURE RISE (ΔT) IN CONTACT ZONES | PRESSURES IN CONTACT ZONES | CONDENSER PRESSURE |
|---|---|---|---|---|
| First Zone | 24 | 68° C | 60 PSIA | 5 PSIG |

-continued

| | ABSORBENT CONCENTRATION (WEIGHT PERCENT OF WATER) | TEMPERATURE RISE (ΔT) IN CONTACT ZONES | PRESSURES IN CONTACT ZONES | CONDENSER PRESSURE |
|---|---|---|---|---|
| Second Zone | 26.5 | 34.5° C | 260 PSIA | |

TABLE II

Heat source temperature 180° C, absorbent is a glycerin solution containing 1.5 percent water.

| | ABSORBENT CONCENTRATION (WEIGHT PERCENT OF WATER) | TEMPERATURE RISE (ΔT) IN CONTACT ZONES | PRESSURES IN CONTACT ZONES | CONDENSER PRESSURE |
|---|---|---|---|---|
| First Zone | 11 | 38° C | 150 PSIA | 3 PSIA |
| Second Zone | 14.1 | 18.5° C | 210 PSIA | |

I claim as my invention:

1. A process for transferring thermal energy comprising contacting steam and a water absorbent solution in a first contact zone under conditions to absorb water, dilute the solution, and raise the temperature of the solution, the solution being in indirect heat exchange with an aqueous stream and raising the temperature of the aqueous stream and converting at least the bulk of the aqueous stream to steam, passing diluted solution from the first contact zone to a second contact zone, passing the aqueous stream of raised temperature produced in the first contact zone to a second contact zone wherein the stream is contacted with the diluted solution from the first contact zone, under conditions to absorb water and heavily dilute the solution, and raise further the temperature of the solution, and transferring heat from the heavily diluted solution to a medium to be heated.

2. The method of claim 1 wherein at least a portion of the steam employed in the first contact zone is produced from water in indirect heat exchange with a thermal energy source.

3. The method of claim 2 wherein the heavily diluted absorbent solution is regenerated and returned to the first contact zone.

4. The method of claim 3 wherein the thermal energy source supplies heat for regeneration of the heavily-diluted absorbent.

5. The method of claim 4 wherein the medium to be heated is a liquid pre-heated by heat exchange with the thermal energy source.

6. The method of claim 5 wherein the thermal energy source is used to preheat the aqueous stream supplied to the first contact zone.

7. The method of claim 1 wherein the water absorbent solution contains an electrolyte.

8. The method of claim 1 wherein the water absorbent solution contains a non-volatile alcohol.

9. The method of claim 1 wherein the water absorbent solution contains a lithium halide.

10. The method of claim 1 wherein the water absorbent solution contains lithium bromide.

11. The method of claim 1 wherein the water absorbent solution contains lithium bromide and calcium bromide.

12. The method of claim 1 wherein the water absorbent solution contains ethylene glycol.

13. The method of claim 1 wherein the water absorbent solution contains glycerin.

14. The method of claim 2 wherein the water absorbent solution contains an electrolyte.

15. The method of claim 2 wherein the water absorbent solution contains a non-volatile alcohol.

16. The method of claim 2 wherein the water absorbent solution contains a lithium halide.

17. The method of claim 2 wherein the water absorbent solution contains lithium bromide.

18. The method of claim 2 wherein the water absorbent solution contains lithium bromide and calcium bromide.

19. The method of claim 2 wherein the water absorbent solution contains ethylene glycol.

20. The method of claim 2 wherein the water absorbent solution contains glycerin.

* * * * *